US006871618B2

(12) United States Patent
Masse

(10) Patent No.: US 6,871,618 B2
(45) Date of Patent: Mar. 29, 2005

(54) VALVE ACTUATING DEVICE, AND METHOD FOR CONTROLLING SAME

(75) Inventor: Serge Masse, Acheres la Foret (FR)

(73) Assignee: Renault Sport, Viry-Chatillon (FR)

( * ) Notice: Subject to any disclaimer, the term of this patent is extended or adjusted under 35 U.S.C. 154(b) by 51 days.

(21) Appl. No.: 10/381,738

(22) PCT Filed: Oct. 5, 2001

(86) PCT No.: PCT/FR01/03069

§ 371 (c)(1),
(2), (4) Date: Aug. 29, 2003

(87) PCT Pub. No.: WO02/29216

PCT Pub. Date: Apr. 11, 2002

(65) Prior Publication Data

US 2004/0112312 A1 Jun. 17, 2004

(30) Foreign Application Priority Data

Oct. 5, 2000 (FR) ..... 00/12712

(51) Int. Cl.[7] ..... F01L 9/02

(52) U.S. Cl. ..... 123/90.12; 123/90.14; 251/61; 251/62; 251/63; 251/63.5

(58) Field of Search ..... 251/12, 25, 30.01, 251/57, 61–63, 63.5; 123/90.12, 90.13, 90.14

(56) References Cited

U.S. PATENT DOCUMENTS

| | | | | |
|---|---|---|---|---|
| 3,682,152 | A | | 8/1972 | Muller-Berner |
| 5,255,641 | A | | 10/1993 | Schechter |
| 5,765,515 | A | | 6/1998 | Letsche |
| 5,833,209 | A | | 11/1998 | Steinrueck |
| 5,992,819 | A | * | 11/1999 | Asskildt et al. ..... 251/63.6 |

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

A device and control method for actuating valves of a motor vehicle internal combustion engine including at least a controlled hydraulic actuator actuating the associated valve that is provided in the form of a cylinder. A mobile piston connected to the valve delimits two opposite hydraulic pressure chambers each supplied with an incompressible fluid and pressure regulated by a control unit such that the pressure prevailing in one of the chambers is alternately higher/lower than that which prevails in the other chamber to actuate the valve. Each pressure chamber of the cylinder is capable of communicating with a corresponding actuating hydraulic pressure source, which includes a pneumatic return mechanism for the fluid.

10 Claims, 3 Drawing Sheets

VALVE ACTUATING DEVICE, AND METHOD FOR CONTROLLING SAME

The invention relates to a device for actuating the valves of a motor-vehicle internal combustion engine.

The invention relates more particularly to a device for actuating the valves of a motor-vehicle internal combustion engine, of the type in which each valve is provided with a rod or stem integral with an actuator, which is operated by a control unit to bring about lifting and return of the associated valve, of the type in which each actuator is constructed in the form of a hydraulic cylinder provided with a barrel, inside which the stem of the associated valve is free to slide coaxially in leaktight relationship, and inside which there is disposed a movable piston, which is integral with the free end of the valve stem and which defines in the barrel two opposite, upper and lower hydraulic pressure chambers, each of which is supplied with an incompressible fluid, and in each of which there is alternately established a pressure of the said fluid, this pressure being regulated by the control unit in such a way that the pressure prevailing in one of the chambers is alternately higher or lower than that prevailing in the other chamber, in order to actuate the hydraulic cylinder and the valve alternately.

There are known numerous examples of actuating devices of this type, which are characterized as "camless".

These devices are designed to replace the conventional mechanical valve-lifting devices, which are provided, for example, with at least one camshaft, which is driven by the crankshaft and which acts directly or indirectly on the valve stems.

The well known advantage of such a device is the ability to exploit different valve-lifting principles, which are selected by the control unit as a function of the engine speed, so as to optimize the operation of the said engine.

As is known, the "camless" actuating devices are provided with actuators of the electromagnetic or hydraulic type.

An electromagnetic actuator is substantially provided with two springs and a metal plate that reciprocates between two coils. When the valve is closed, the upper spring is kept compressed by the plate, which is attracted to the upper coil, which is excited by an electric current. No excitation is created by the lower coil, and the lower spring remains in rest position. When the flow of current in the upper coil is interrupted, the plate is released, allowing the valve to open while compressing the lower spring.

Thus the actuating device is characterized as "oscillating", in the sense that the potential energy of the upper spring is transferred to the plate in the form of kinetic energy and then transferred in the form of potential energy once more to the lower spring.

The valve is then held open by establishing a flow of current in the lower coil. Interruption of the current in the lower coil causes the valve to close and the upper spring to be compressed once again.

Actuating devices provided with electromagnetic actuators suffer from the disadvantage of necessitating high electrical power to ensure that they can operate. As an example, the only power consumed by the actuators of a vehicle with a "camless" engine can reach a value of 2 kilowatts at maximum engine power in the case of an engine with four cylinders and 16 valves, whereas a vehicle with a conventional engine consumes the same power to ensure that all of its electrical accessories are operational. For this reason, the supply voltage of the electrical circuit of the vehicle must be increased from the conventional value of 12 volts to 42 volts in order to reduce the size of the generator.

Furthermore, the electromagnetic actuating devices prove to be poorly suited to engines running at high speeds. For such engines, in fact, the electromagnetic actuators are not capable of accelerating moving parts sufficiently at engine speeds beyond the usual values of standard engines.

U.S. Pat. No. 5,562,070 describes and illustrates a hydraulic actuating device provided with a hydraulic pump capable of delivering pressurized oil to two opposite hydraulic chambers of a hydraulic cylinder forming the actuator, in such a way as to induce alternate movements of the actuator and of the valve. In such a device, the consecutive and opposite movements of the hydraulic cylinder are obtained by alternately exerting, on each of the opposite faces of the piston of the actuator, a pressure higher than that exerted on the other face of the piston. Under these conditions, such a hydraulic actuating device consumes a large quantity of hydraulic energy, especially when the engine speed increases and necessitates high valve-opening and valve-closing velocities. Because of this fact, such a device achieves only few advantages compared with a conventional distribution device.

Furthermore, this device is not capable of effectively controlling the velocity of the valve at the end of the closing travel, or at the very least it can control the velocity of the valve only at the cost of additional consumption of hydraulic energy. Such a device therefore suffers either from the disadvantage that there is a risk of damaging the seat of the said valve and of generating noise if the valve closes on its seat at excessive velocity, or from the disadvantage that it causes large drops in engine power.

U.S. Pat. No. 5,572,961 describes a similar device, in which valve return is achieved by means of a spring. Such a device is of the previously described "oscillating" type, and permits considerable reduction of the consumption of hydraulic energy necessary for actuation of the valve. Nevertheless, this device proves to be unsuitable at high engine speeds, and especially at speeds that cause "valve chatter", when the spring reaches a resonance condition with the risk of undergoing uncontrollable oscillations of great amplitude.

To overcome these disadvantages, the invention proposes a hydraulic oscillating device constructed in the form of a hydropneumatic "camless"distribution system.

To this end, the invention proposes a device of the type described hereinabove, characterized in that each hydraulic pressure chamber of the hydraulic cylinder is capable of being placed in communication with at least one independent hydraulic pressure source, known as the actuating source, which is associated with only the said chamber and which is provided with means for elastic return of the fluid, such means being intended to recover the kinetic energy of the valve during movement thereof in a particular direction, in view of subsequent movement of the valve in the opposite direction.

According to a preferred embodiment of the invention, the means for return of the fluid are pneumatic.

According to another embodiment of the invention, the return are mechanical.

According to other characteristics of the invention:

- at least one of the hydraulic chambers is capable of being placed in communication with an additional source, known as the discharge source, in which the hydraulic fluid is subjected to reduced pressure,
- the control unit is capable of regulating the pressures prevailing in the hydraulic pressure chambers of the hydraulic cylinder, by alternately operating an actuating solenoid valve, which is interposed between one of the hydraulic pressure chambers and its associated actuating source, and a discharge solenoid valve, which is interposed between the said hydraulic pressure chamber and the discharge source, each actuating source is composed of a hydropneumatic accumulator provided with an envelope, inside which a membrane defines a return chamber and an actuating chamber, the return chamber being isolated and filled with a compressible gas, and the actuating chamber being in communication with the corresponding upper or lower chamber of the associated hydraulic cylinder, and filled with incompressible fluid, the discharge source is provided with a reservoir, which is placed in communication with an engine crankcase, in which there prevails a reduced pressure, the upper pressure chamber of the hydraulic cylinder is capable of being placed in communication with a first hydropneumatic accumulator or with the discharge source by means of the respective actuating and discharge solenoid valves, and the lower pressure chamber of the hydraulic cylinder is in direct communication with a second actuating hydropneumatic accumulator, a check valve is interposed between the upper chamber of the hydraulic cylinder and the first hydropneumatic accumulator, each actuating chamber of the hydropneumatic accumulators is connected to a pressure-holding device, which is capable of maintaining it at a set pressure while the valve is closed.

The invention also proposes a control method for a device of the type described hereinabove, characterized in that:

in a first stage, in which the valve is at rest, the unit commands the actuating solenoid valve to close and the discharge solenoid valve to open, the first hydropneumatic accumulator being maintained by the pressure device at a first set pressure and the second hydropneumatic accumulator being maintained at a second set pressure, the first set pressure being higher than the second set pressure and the second set pressure being higher than the reduced pressure of the engine crankcase, then in a second stage, in which the valve is lifted, the unit commands the discharge solenoid valve to close and the actuating solenoid valve to open, then in a third stage, in which the valve is returned, the unit commands the actuating solenoid valve to close, then in a fourth stage, in which the valve becomes closed completely, the unit commands the discharge solenoid valve to open as far as the first rest stage.

Other characteristics and advantages of the invention will become evident upon reading the detailed description hereinafter, which description will be understood by referring to the attached drawings, wherein:

In the description hereinafter, identical reference symbols denote identical parts or parts having similar functions.

FIG. 1 illustrates a general diagram of a device 10 for actuating a valve 12 of a motor-vehicle internal combustion engine, the said valve being constructed according to the invention.

Figure 1:
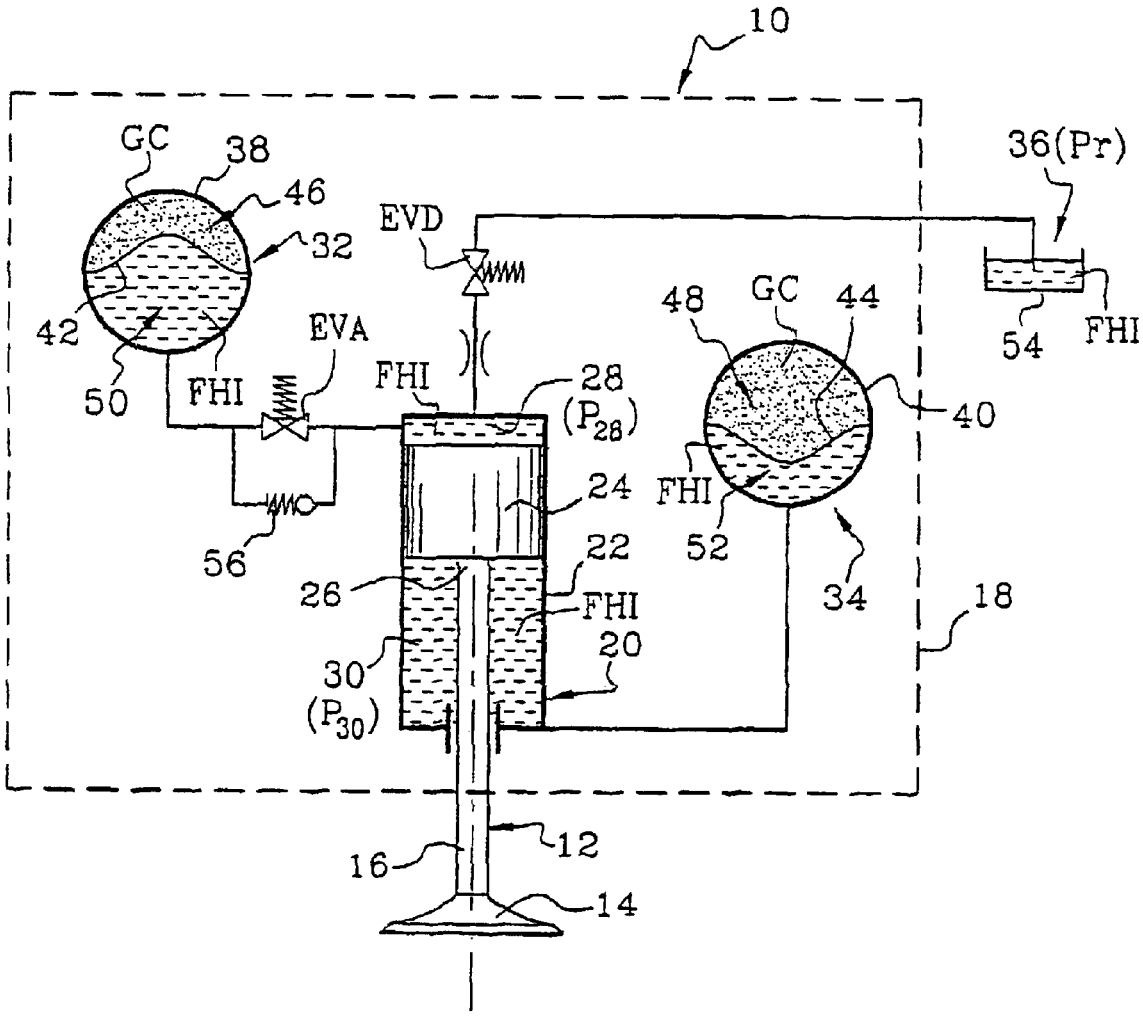
FIG. 1 is a schematic view of a device according to the invention, illustrated in the rest position of the valve.
Figure 2:
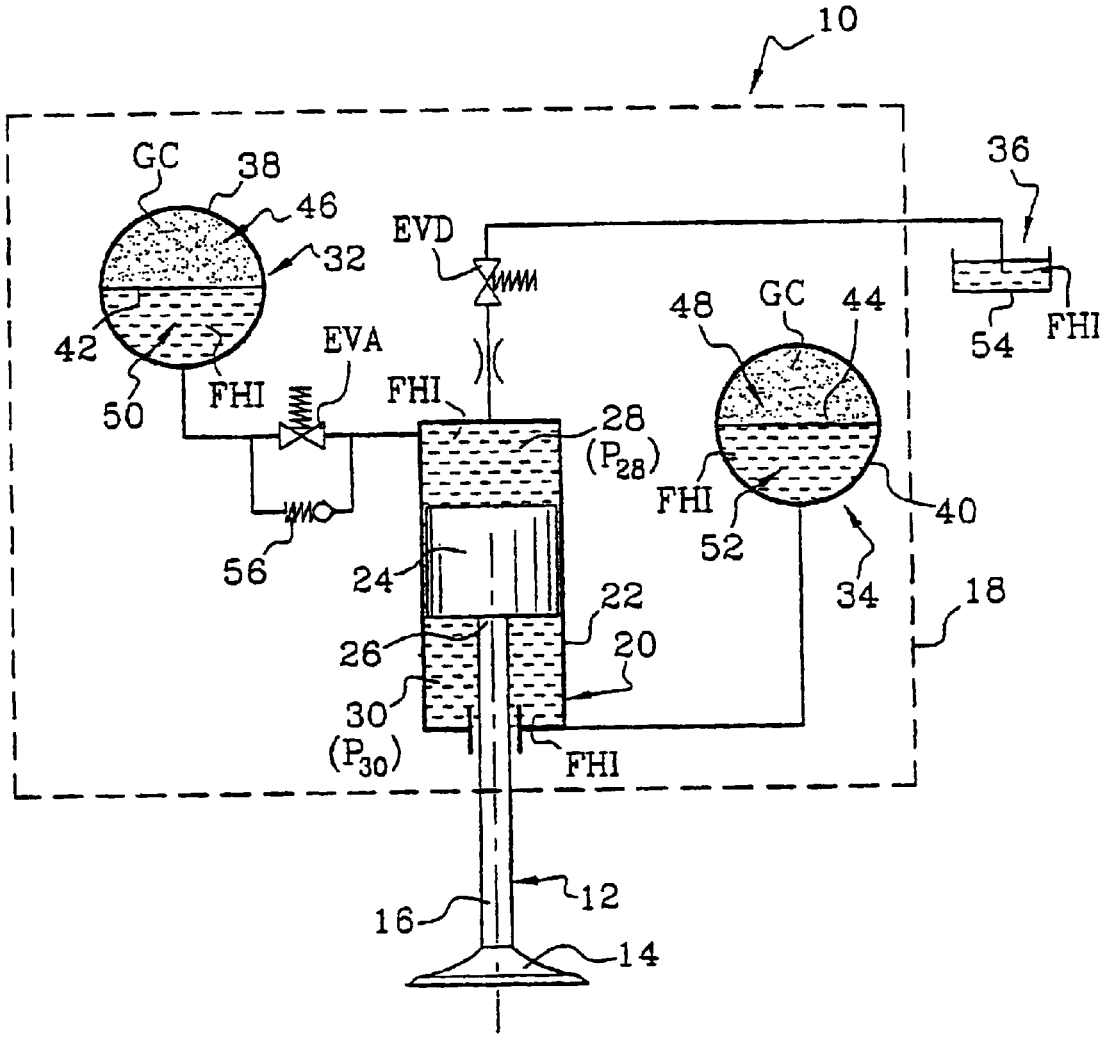
FIG. 2 is a schematic view of the device of FIG. 1, illustrated in the lifted position of the valve.
Figure 3:
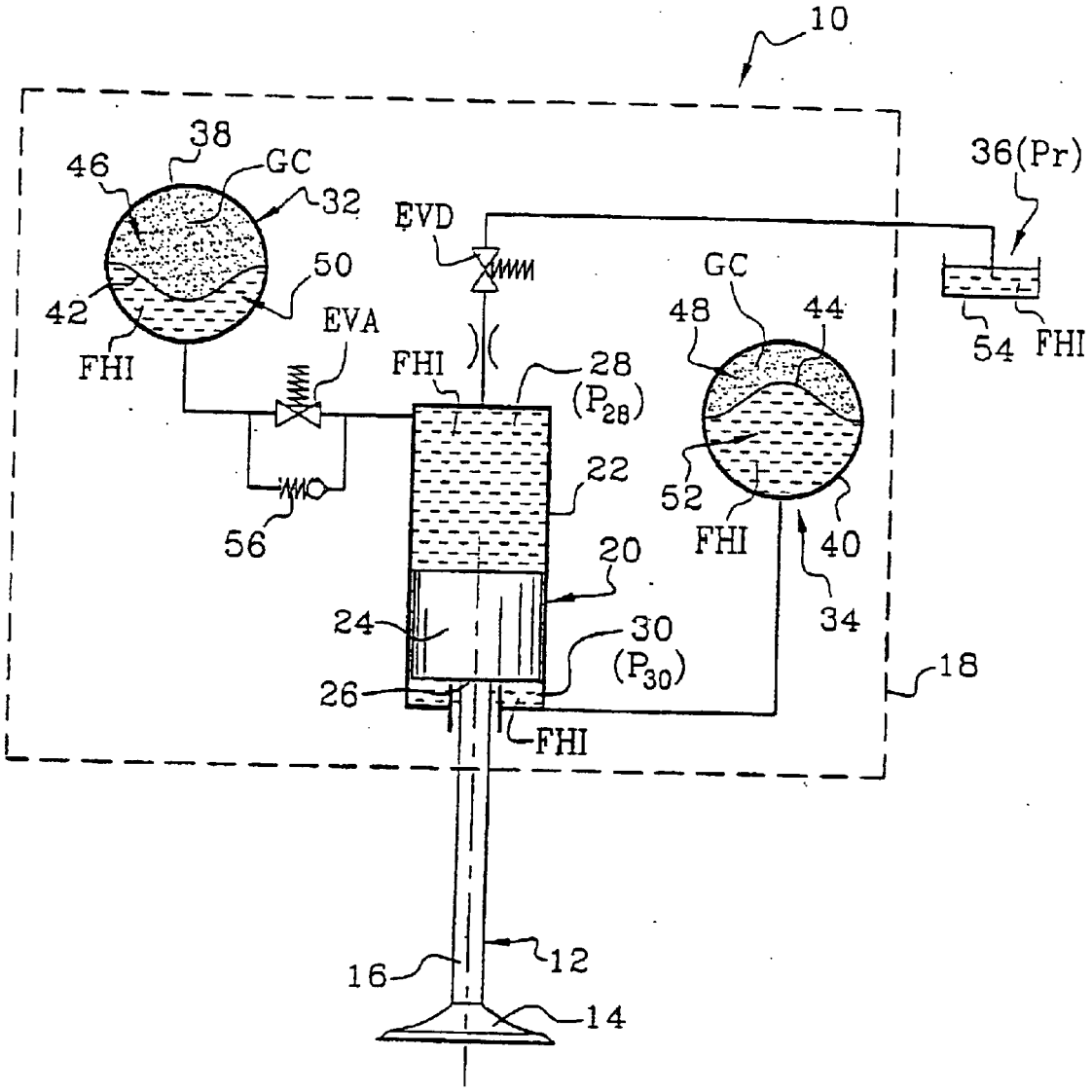
FIG. 3 is a schematic view of the device of FIG. 1, illustrated in the returned position of the valve.

In this device 10, each valve 12 is formed by an enlarged head portion 14 and a rod or stem 16, which is integral with enlarged head portion 14. Stem 16 is integral with an actuator 18, which is operated by a control unit, for example electronic (not illustrated), to bring about lifting and return of valve 12 to its seat (not illustrated).

Actuator 18 is constructed in known manner in the form of a hydraulic cylinder 20, which is provided with a barrel 22, inside which stem 16 of the associated valve 12 is free to slide coaxially in leaktight relationship, and inside which there is disposed a movable piston 24, integral with free end 26 of the stem of valve 12. In barrel 22, piston 24 defines two opposite hydraulic pressure chambers, which are supplied with an incompressible hydraulic fluid FHI, such as oil. More particularly, therefore, piston 24 defines in barrel 22 an upper pressure chamber 28 and a lower pressure chamber 30.

During operation of device 10, there is established, inside each of upper and lower chambers 28 and 30 respectively, a pressure of the said fluid FHI, this pressure being regulated by the control unit in such a manner that the pressure prevailing in one of the chambers 28 or 30 is alternately higher or lower than the pressure prevailing in the other chamber, in order to actuate hydraulic cylinder 20 and thus valve 12 alternately.

Thus, when the pressure $P_{28}$ prevailing in chamber 28 is higher than the pressure $P_{30}$ prevailing in chamber 30, the resultant of the pressure forces acting on each of the opposite faces of piston 24 pushes piston 24 downward in the direction of opening of valve 12. Conversely, when the pressure $P_{30}$ prevailing in chamber 30 is higher than the pressure $P_{28}$ prevailing in chamber 28, the resultant of the pressure forces acting on each of the opposite faces of piston 24 pushes piston 24 upward in the direction of closing of valve 12.

According to the invention, and to overcome the aforesaid disadvantages of the known devices, each hydraulic pressure chamber 28 or 30 of hydraulic cylinder 22 is capable of being placed in communication with at least one independent hydraulic pressure source, known as an actuating source, which is associated with only the said chamber 28 or 30 and which is provided with pneumatic means for elastic return of the fluid FHI, which means are intended to recover the kinetic energy of valve 12 during the movement thereof in a particular direction, in view of subsequent movement of valve 12 in the opposite direction.

Thus device 10 according to the invention is preferably provided with two actuating sources 32 and 34. The invention is in no way limited by this arrangement, and device 10 could be provided with more than one actuating source associated with each of pressure chambers 28 or 30 of hydraulic cylinder 12.

This configuration exhibits numerous advantages compared with the devices known from the prior art.

As is known, although a conventional device for the actuation of valves by camshafts suffers from the disadvantage that it can exploit only one valve-lifting principle, it is actually capable on the other hand of effectively controlling the velocity of closing of the valve. By providing the cams with a highly curved profile in the zone in which they are supposed to command the valve to close, it is possible to impose a reduced velocity of the valve as it approaches its seat, thus reducing the risks of wear of this seat and prolonging the useful life of the device.

Heretofore the majority of "camless" devices have suffered from the disadvantage of abrupt opening and closing of the valve, leading after a certain time to pronounced wear of the seat and in most cases to noise.

The device according to the invention is capable of overcoming this disadvantage by the fact that, as valve 12 approaches its extreme actuation positions, it is moved at practically zero velocity, which can be controlled by a reduction of hydraulic head upstream from solenoid valve EVD. This reduction of head can be a function of the valve position.

According to the invention, opening of valve 12 is achieved by the fact that a first actuating source transfers all of its potential energy to valve 12 in the form of kinetic energy, which at the end of travel is in turn transferred in the form of potential energy to a second actuating source when valve 12 arrives at its fully open position. Conversely, to achieve closing of valve 12, the second actuating source transfers all of its potential energy to valve 12 in the form of kinetic energy, which at the end of travel is in turn transferred in the form of potential energy to the first actuating source when valve 12 arrives at its closed position. Since the kinetic energy of valve 12 is almost zero during its closing movement, and since it is also a multiple of the square of the velocity, the velocity of valve 12 is therefore almost zero as well.

Another advantage of device 10 according to the invention is that it consumes little hydraulic energy.

Since the energy is stored in actuating pressure sources 32 and 34, it is not necessary to supply additional hydraulic pressure to reverse the movement of valve 12, as was the case for the devices known from the prior art. Thus, as will be seen, the hydraulic consumption of such a device 10 ultimately amounts to a minimum input of hydraulic energy for the purpose of compensating for the losses of kinetic energy of valve 12 during its movement. Such losses are due in particular to the various friction phenomena that can take place in actuator 12.

Furthermore, according to the invention, at least one of the hydraulic chambers 28 or 30 is capable of being placed in communication with an additional source 36 known as the discharge source, in which hydraulic fluid FHI is subjected to a reduced pressure.

Advantageously, therefore, the hydraulic fluid is capable of being brought to a reduced pressure in one of the hydraulic pressure chambers, in such a way as to ensure that valve 12 is stable in its extreme position associated with the establishment of a reduced pressure in the said chamber.

According to the invention, regulation of the pressures $P_{28}$, $P_{30}$ exerted on each of the opposite faces of piston 24 in order to induce ascending or descending movements thereof is controlled entirely by the control unit.

To this end, the control unit is generally capable of regulating the pressures $P_{28}$, $P_{30}$ prevailing in hydraulic pressure chambers 28 and 30 of hydraulic cylinder 20 by alternately operating an actuating solenoid valve EVA, which is interposed between one of the hydraulic pressure chambers 28 or 30 and its associated actuating source 32 or 34, and a discharge solenoid valve EVD, which is interposed between the said hydraulic pressure chamber 28 or 30 and discharge source 36.

In the preferred embodiment of the invention, each actuating source 32 or 34 is composed of a hydropneumatic accumulator 32 or 34, which is provided with an envelope 38, 40, inside which a membrane 42, 44 defines a return chamber 46, 48 and an actuating chamber 50, 52, the return chamber 46, 48 being isolated and filled with a compressible gas GC, and actuating chamber 50, 52 being in communication with corresponding upper chamber 28 or lower chamber 30 of associated hydraulic cylinder 12, and filled with incompressible fluid FHI.

Advantageously, the compressible gas GC contained in return chambers 46 and 48 of hydraulic accumulators 32 and 34 ensures that an elastic return action can be exerted on the hydraulic fluid FHI contained in actuating chambers 50 and 52, and by this fact it constitutes a pneumatic spring that permits the kinetic energy of valve 12 to be stored. Device 10 behaves in the same way as an oscillating device with electromechanical actuators, without exhibiting the disadvantages thereof, or in other words without exhibiting the disadvantages of significant inertia.

Furthermore, discharge source 36 is provided with a reservoir 54, which is placed in communication with an engine crankcase (not illustrated), in which a reduced pressure "Pr" prevails.

It is appropriate to note that, as defined heretofore, discharge source 36 can equally well be placed in communication with either one or the other of upper chamber 28 or chamber 30 of hydraulic cylinder 22 without modifying the operating principle of device 10.

Nevertheless, it is desirable that the rest position of valve 22, or in other words its position in which the hydraulic pressure in one of the chambers of actuator 20 is reduced, corresponds to its closed position, in order to guarantee perfect leaktightness of enlarged head portion 14 of valve 12 against its seat.

For this purpose, upper pressure chamber 28 of hydraulic cylinder 20 is capable of being placed in communication with first actuating hydropneumatic accumulator 32 or with discharge source 36 by means of actuating and discharge solenoid valves EVA and EVD respectively, and lower pressure chamber 30 of hydraulic cylinder 20 is in direct communication with second hydropneumatic accumulator 34.

In addition, a check valve 56 can be interposed between upper chamber 28 of hydraulic cylinder 20 and first hydropneumatic accumulator 32.

Finally, each actuating chamber 50 or 52 of hydropneumatic accumulators 32 or 34 is connected to a pressure-holding device (not illustrated), which is capable of maintaining this chamber at a set pressure $Pc_{32}$ and $Pc_{34}$ respectively while valve 12 is closed.

This device makes it possible in particular to compensate for the hydraulic energy losses of the fluid during the movements of valve 12. Such losses can be due in particular to friction of the rod of valve 12 in barrel 22, to friction of piston 24 in the barrel, and to losses of the "fluid friction" type generated by the pressure forces acting in the body of fluid FHI.

In this configuration, the invention also proposes a control method for assuring operation of the device 10 described in the foregoing.

In a first stage, in which valve 12 is at rest, as illustrated in FIG. 1, the unit commands actuating solenoid valve EVA to close and discharge solenoid valve EVD to open, first hydropneumatic accumulator 32 being maintained by the pressure device at a first set pressure $Pc_{32}$ and second hydropneumatic accumulator 34 being maintained at a second set pressure $Pc_{34}$, first set pressure $PC_{32}$ being higher than second set pressure $Pc_{34}$ and second set pressure $Pc_{34}$ being higher than the reduced pressure "Pr" of the engine crankcase.

Valve 12 is therefore at rest and closed, since the pressure $P_{28}$ prevailing in upper chamber 28 of hydraulic cylinder 22 is equal to the reduced pressure "Pr" of the crankcase and is therefore lower than the set pressure $Pc_{32}$ prevailing in the lower chamber of the hydraulic cylinder. The device is said to be "charged", since actuating chamber 50 of accumulator 32, notwithstanding the opening of solenoid valve EVA, is ready to establish the set pressure $Pc_{32}$ in upper chamber 28 of the hydraulic cylinder.

In a second stage, in which valve 12 is lifted, the unit commands discharge solenoid valve EVD to close and actuating solenoid valve EVA to open. Since the pressure $P_{28}$, which is equal to the set pressure $Pc_{32}$ prevailing until now in upper chamber 28, is higher than the set pressure $Pc_{34}$ prevailing in lower chamber 30 of the hydraulic cylinder, the resultant of the pressure forces exerted on piston 24 causes it to be displaced downward in the direction of opening of valve 12.

As valve 12 opens, its movement leads to an increase in the volume of upper chamber 28, thus also to decompression of the gas GC contained in return chamber 46 of accumulator 32, and a decrease in the volume of lower chamber 30, and thus also compression of the gas GC contained in return chamber 48 of accumulator 34.

The acceleration of valve 12 decreases until it reaches zero when the pressures prevailing in the two return chambers 46 and 48 are in equilibrium. This position of valve 12 corresponds to a maximum kinetic energy stored by valve 12, and therefore to its highest velocity. Thereafter, as the displacement of valve 12 continues, valve 12 decelerates to the point that it reaches its fully open position as its velocity becomes zero.

At this instant, practically all of the kinetic energy of valve 12 has been reconverted to potential energy stored in the pneumatic spring constituted by the gas GC contained in return chamber 48 of hydropneumatic accumulator 34. Disregarding energy losses, the pressure in return chamber 48 is then close to the pressure that prevailed in return chamber 46 at the beginning of the second stage.

Because of this fact, the hydraulic fluid FHI is now substantially at the first set pressure $Pc_{32}$ in lower chamber 30 of the hydraulic cylinder, and it is substantially at the second set pressure $Pc_{34}$ in upper chamber 30 of the hydraulic cylinder. The unit then commands solenoid valve EVA to close.

Since the resultant of the pressure forces $P_{28}$, $P_{30}$ acting on piston 24 is now reversed, in a third stage, in which valve 12 is returned, the unit commands actuating solenoid valve EVA to close.

Valve 12 then begins its closing movement as soon as the pressure $P_{28}$ in upper chamber 28 has risen sufficiently. If the device is provided with check valve 56, a dead time during which the valve is lifted to fully open position can be established by selection of the threshold pressure of this check valve. It may be possible to reduce this dead time to a negligible value by lightly counterbalancing the check valve.

The characteristics of the closing movement of valve 12 are exactly similar to those of its opening movement. It will be appropriate to note that, because of this fact, valve 12 closes back on its seat with practically zero velocity, and therefore does not cause wear of the seat, thus considerably prolonging the useful life of the engine in question.

Finally, in a fourth stage, corresponding to complete closing of valve 12, which occurs when valve 12 has been closed again, the unit commands solenoid valve EVD to open in order to reduce the residual pressure $P_{28}$ in upper chamber 28 of the hydraulic cylinder. Thus, as soon as the pressures have stabilized, device 10 is restored to the configuration of the first stage, in which valve 12 is at rest.

It will be noted that, if the device is provided with a check valve, valve 12 closes again automatically at the end of a specified time interval associated with the trip threshold of the said check valve.

It is appropriate to note that, in an alternative embodiment, it is possible to control this time interval between the second and third stages, or in other words to immobilize valve 12 in open position for some time without the use of check valve 56. In this configuration it is possible, for example in the case in which the device is intended for application to an exhaust valve 12, to hold valve 12 open in order to favor readmission of the burned gases as the engine piston continues its travel toward the bottom dead point. This corresponds to the well known process of exhaust gas recycling (EGR).

This configuration could be employed in particular in the case of a standard vehicle engine, for which minimum consumption is desired.

In this case, the return of fluid FHI to actuating chamber 50 of accumulator 50 is assured no longer by check valve 56 but by solenoid valve EVA. After a specified delay time, the control unit can command actuating solenoid valve EVA to open during the third stage, whereby the hydraulic fluid circulates through this solenoid valve instead of circulating through check valve 56, as is the case in the special embodiment of the invention. This delay time then corresponds to the time during which valve 12 is immobilized in open position.

The invention therefore makes it possible to achieve pneumatic control of the valves 12 of a standard internal combustion engine or of an engine operating at high speed, in a manner that is reliable and inexpensive and that ensures low energy consumption by the said engine.

What is claimed is:

1. A device for actuating valves of a motor-vehicle internal combustion engine, in which each valve is provided with a rod or stem integral with an actuator operated by a control unit to bring about lifting and return of an associated of the valves, each actuator being in a form of a hydraulic cylinder provided with a barrel, inside which barrel the stem of the associated valve is free to slide coaxially in a leaktight relationship, and inside which barrel a movable piston is disposed that is integral with a free end of the valve stem and that defines in the barrel two opposite upper and lower hydraulic pressure chambers, each pressure chamber being supplied with an incompressible fluid, and in each of which pressure chamber a pressure of the fluid is alternately established, the pressure being regulated by the control unit such that pressure prevailing in a first one of the chambers is alternately higher or lower than pressure prevailing in a second one of the chambers, to actuate the hydraulic cylinder and the valve alternately, wherein each hydraulic pressure chamber of the hydraulic cylinder is configured to be placed in communication with at least one independent respective hydraulic pressure source associated with only the respective chamber and including means for elastic returning of the fluid, the means for elastic returning further for recovering kinetic energy of the associated valve during movement of the associated valve in a particular direction, in view of subsequent movement of the associated valve in a direction opposite to the particular direction.

2. A device according to claim 1, wherein the means for elastic returning is pneumatic.

3. A device according to claim 1, wherein at least one of the hydraulic chambers is configured to be placed in communication with a discharge source in which the hydraulic fluid is subjected to reduced pressure.

4. A device according to claim 3, wherein the control unit is configured to regulate the pressures prevailing in the hydraulic pressure chambers of the hydraulic cylinder, by alternately operating an actuating solenoid valve interposed between one of the hydraulic pressure chambers and its respective actuating source, and a discharge solenoid valve interposed between the hydraulic pressure chamber and the discharge source.

5. A device according to claim 4, wherein each actuating source is composed of a hydropneumatic accumulator provided with an envelope, inside which envelope a membrane defines a return chamber and an actuating chamber, the return chamber being isolated and filled with a compressible gas, and the actuating chamber being in communication with the corresponding upper or lower chamber of the associated hydraulic cylinder, and filled with incompressible fluid.

6. A device according to claim 5, wherein the upper pressure chamber of the hydraulic cylinder is configured to be placed in communication with a first hydropneumatic accumulator or with the discharge source by the respective actuating and discharge solenoid valves, and wherein the lower pressure chamber of the hydraulic cylinder is in direct communication with a second actuating hydropneumatic accumulator.

7. A device according to claim 6, wherein a check valve is interposed between the upper chamber of the hydraulic cylinder and the first hydropneumatic accumulator.

8. A device according to claim 3, wherein the discharge source is provided with a reservoir, which is placed in communication with an engine crankcase, in which a reduced pressure prevails.

9. A device according to claim 5, wherein each actuating chamber of the hydropneumatic accumulators is connected to a pressure-holding device, which is configured to maintain the respective actuating chamber at a set pressure while the associated valve is closed.

10. A method for control of a device for actuating the valve of a motor-vehicle internal combustion engine according to claim 7, comprising:

commanding, in a first stage, in which the valve is at rest, the actuating solenoid valve to close and the discharge solenoid valve to open, the first hydropneumatic accumulator being maintained by the pressure device at a first set pressure and the second hydropneumatic accumulator being maintained at a second set pressure, the first set pressure being higher than the second set pressure and the second set pressure being higher than the reduced pressure of the engine crankcase; then commanding, in a second stage, in which the valve is lifted, the discharge solenoid valve to close and the actuating solenoid valve to open; then commanding, in a third stage, in which the valve is returned, the actuating solenoid valve to close; and then commanding, in a fourth stage, in which the valve becomes closed completely, the discharge solenoid valve to open as far as the first rest stage.

* * * * *